US009387382B2

(12) United States Patent
Long

(10) Patent No.: US 9,387,382 B2
(45) Date of Patent: Jul. 12, 2016

(54) ROPE BAT

(71) Applicant: Gary Long, Austin, TX (US)

(72) Inventor: Gary Long, Austin, TX (US)

( * ) Notice: Subject to any disclaimer, the term of this patent is extended or adjusted under 35 U.S.C. 154(b) by 0 days.

(21) Appl. No.: 14/507,417

(22) Filed: Oct. 6, 2014

(65) Prior Publication Data

US 2015/0119172 A1 Apr. 30, 2015

Related U.S. Application Data

(60) Provisional application No. 61/896,728, filed on Oct. 29, 2013.

(51) Int. Cl.
*A63B 69/00* (2006.01)
*A63B 15/00* (2006.01)
*A63B 59/06* (2006.01)

(52) U.S. Cl.
CPC ..... *A63B 69/0002* (2013.01); *A63B 15/00* (2013.01); *A63B 59/06* (2013.01); *A63B 2069/0008* (2013.01)

(58) Field of Classification Search
CPC ..... A63B 15/00; A63B 69/0002; A63B 21/00043; A63B 69/3632; A63B 21/1645
USPC ..... 473/422, 457, 464, 458, 219, 424, 228, 473/256, 232, 229; D21/791
See application file for complete search history.

(56) References Cited

U.S. PATENT DOCUMENTS 3,229,980 A * 1/1966 Silberman ..... A63B 69/3632 473/232
3,428,325 A * 2/1969 Atkinson ..... A63B 15/00 473/457
3,921,976 A * 11/1975 Lane ..... A63B 69/0002 473/458
4,249,729 A * 2/1981 Gabrielidis ..... A63B 21/00043 473/464
4,343,473 A * 8/1982 Laursen ..... A63B 69/3632 473/256
4,513,965 A * 4/1985 Aschermann ..... A63B 69/0002 473/458
4,555,111 A * 11/1985 Alvarez ..... A63B 69/0002 473/457
D326,493 S * 5/1992 Perry ..... D21/791
5,865,686 A * 2/1999 MacGregor ..... A63B 15/00 473/228
6,503,149 B2 * 1/2003 Jelinek ..... A63B 15/00 473/219
6,786,841 B1 * 9/2004 Dixon ..... A63B 69/0002 473/424
6,910,973 B2 * 6/2005 Kuster ..... A63B 21/1645 473/219
7,235,024 B2 * 6/2007 Lefebvre ..... A63B 15/00 473/457
7,326,124 B1 * 2/2008 Fairbanks ..... A63B 69/3632 473/256
8,172,696 B2 * 5/2012 Lum ..... A63B 69/3623 473/256
8,920,256 B1 * 12/2014 Ffitch ..... A63B 59/0077 473/219
2009/0082124 A1 * 3/2009 Hackenberg ..... A63B 53/14 473/256
2010/0130313 A1 * 5/2010 Bastian ..... A63B 15/00 473/457
2015/0119172 A1 * 4/2015 Long ..... A63B 69/0002 473/457

* cited by examiner

*Primary Examiner* — Mitra Aryanpour
(74) *Attorney, Agent, or Firm* — Pierson IP, PLLC

(57) ABSTRACT

Embodiments disclosed herein describe systems and methods for a baseball or softball (referred to hereinafter collectively and independently as "baseball") hitting aid. The baseball hitting aid may be configured to teach a baseball player the correct swing technique and to generate centrifugal force to hit a baseball off a tee.

6 Claims, 2 Drawing Sheets

ROPE BAT

CROSS-REFERENCE TO RELATED APPLICATIONS

This application claims a benefit of priority under 35 U.S.C. §119 to Provisional Application No. 61/896,728 filed on Oct. 29, 2013, which is fully incorporated herein by reference in its entirety.

BACKGROUND INFORMATION

1. Field of the Disclosure

Examples of the present disclosure are related to a baseball batting practice aid, and more specifically to a baseball hitting aid comprising a rigid handle, a woven fabric as a shaft, and a weighted head.

2. Background

Conventionally to practice hitting a baseball, a baseball player may have a pitcher throw batting to the baseball player or the baseball player may practice hitting the baseball off a tee. When a baseball player practices hitting the baseball off of the tee, a coach may view the baseball player's swing technique and mechanics. Based on the coach's outlook of the baseball player's technique for swinging the bat, the coach may make recommendations to the baseball player on how to improve the baseball player's swing.

However, circumstances may arise where the coach is not present to view the baseball player's technique for swinging the bat, the coach may not have the requisite knowledge about baseball to make recommendations on the baseball player's swing, or the baseball player may not be able to adjust his swing based on the coach's recommendations to improve the baseball player's swing.

Accordingly, needs exists for a baseball hitting aid that that will effectively and efficiently improve a baseball player's swing, where the baseball player may be able to utilizing the hitting aid if the baseball player uses a proper swing technique to hit the baseball.

SUMMARY

Embodiments disclosed herein describe systems and methods for a baseball or softball (referred to hereinafter collectively and independently as "baseball") hitting aid. The baseball hitting aid may be configured to teach a baseball player the correct swing technique to generate centrifugal force to hit a baseball off a tee or from tossing/pitching the baseball. The baseball hitting aid may be configured to teach correct hitting concepts and automatically correct a baseball player's swing flaws.

The hitting aid may be configured to maximize the baseball player's centrifugal force by requiring or desiring the baseball player to turn, rotate, or spin (referred to herein after individual and collectively as "spin") their torso to produce and maintain centrifugal force to hit a baseball off a batting tee. The centrifugal force generated by the baseball player may be applied to the hitting aid positioned in the baseball player's hands, wherein the hitting aid may be forced away from the center of the baseball player's mass. To increase the centrifugal force applied to the hitting aid, the baseball player may move their torso forward, while keeping their hand's at a stationary position. Therefore, as the baseball player moves their torso forward, the baseball player's hands will be further away from the initial position of the baseball player's torso. The baseball player's hands may then be pulled in response to the baseball player spinning their torso, and the force generated by the centrifugal force and the baseball players hands may be used to hit a baseball.

As such, through the hitting aid the baseball player may learn the importance of lag, how the baseball player's hands must be inside the ball, how the body acts as a kinesthetic chain, and how the baseball player's hands, arms, and torso are involved in a series of connected movements to swing a baseball bat.

In embodiments, responsive to the baseball player spinning their torso, a barrel of the hitting aid may extend away from the baseball player's torso, as the baseball player spins their torso at a faster rotational speed the hitting aid may rise, and a barrel of the hitting aid may come into contact with a baseball positioned on a batting tee.

In embodiments, responsive to the baseball player generating sufficient centrifugal force by spinning their torso at a high enough rotational speed, the centrifugal force applied to the hitting aid may require, impel, of force the hitting aid to change from a first position to a second position, wherein in the first position the hitting aid is a curved device and in the second position the hitting aid is a linear device.

In embodiments, if the baseball player does not generate sufficient centrifugal force applied to the hitting device, the hitting device may not change from the first position to the second position.

To this end, the hitting aid may be utilized by a baseball player to improve their rotational speed while hitting a baseball, and if the baseball does not generate sufficient centrifugal force then the hitting aid may not be utilized to hit a baseball off a tee. Additionally, the hitting aid may have the following advantages:

- Clearly demonstrates how centrifugal force applies to hitting
- Clearly demonstrates the "kinetic chain" and how to build "torque"
- Forces hitter to keep the "hands inside the ball" and to lead with the hands
- Keeps swing "connected" and tight . . . hands cannot get away from the body.
- Promotes an effective "load"
- Promotes a short, quick swing
- Eliminates "casting", or throwing the barrel of the bat out prematurely
- Eliminates "looping" or allowing the barrel of the bat to get below the plane of the ball
- Eliminates a "hitch", or the dropping of the hands before the swing begins
- Clearly demonstrates the role and importance of "lag"

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
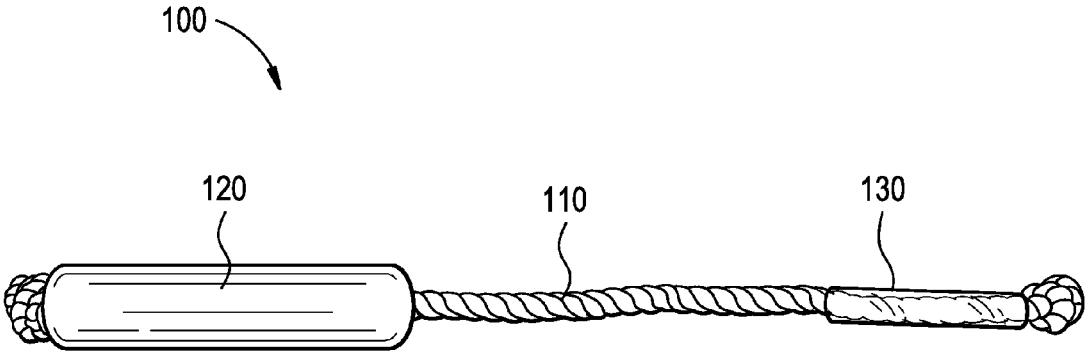
FIG. 1 depicts one about of a baseball hitting aid.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

Additionally, any examples or illustrations given herein are not to be regarded in any way as restrictions on, limits to, or express definitions of any term or terms with which they are utilized. Instead, these examples or illustrations are to be regarded as being described with respect to one particular embodiment and as being illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms. Language designating such nonlimiting examples and illustrations includes, but is not limited to: "for example," "for instance," "e.g.," and "in one embodiment."

FIG. 1 depicts a baseball hitting aid 100 configured to assist in increasing the rotational speed of a baseball player's torso when swinging a baseball bat. Baseball hitting aid 100 may also be configured to teach a baseball player to have proper fundamentals when swinging a baseball bat without a coach being present. Baseball hitting aid 100 may include a rope shaft 110, a weighted barrel 120, and a semi-rigid handle 130.

Rope shaft 110 may be constructed of any long, stringy, fibrous material, such as natural or synthetic fibers. Rope shaft may be comprised of any woven fabric, wherein any point of the shaft may be bend, twisted, folded, etc. For example, rope shaft 110 may be comprised of linen, cotton, hemp, nylon, polyesters, etc. However, rope shaft 110 may be any material that is flexible that may be bent or manipulated in a first position when no force is applied to rope shaft 110 and linear in a second position when rotational force is applied to rope shaft 110. In embodiments, if rope shaft 110 receives centrifugal force responsive to a baseball player spinning their torso, rope shaft 110 may be configured to be a linear shaft in the second position. The diameter of rope shaft 110 may be a length to simulate a conventional baseball bat, such as one inch in diameter. Rope shaft 110 may be thirty-four inches long, which may simulate the length of a baseball bat. In embodiments, rope shaft 110 may be comprised of woven materials, so any point of rope shaft 110 may be bent if the baseball player does not apply sufficient rotational force to rope shaft 110.

Rope shaft 110 may further include markings or delineations to identify different lengths of conventional baseball bats, such that baseball players that use different length bats may be able to identify a corresponding bat length on rope shaft 110. For example, a marking two inches from a first end of rope shaft 110 may indicate a position on rope shaft 110 where a baseball player should place their hands to simulate the length of a thirty-two inch baseball bat.

Barrel 120 may be positioned on a second end of rope shaft 110, and may be configured to come into contact with a baseball. Barrel 120 may be comprised of a soft material, such as plastic, rubber, foam, polyurethane, etc. Barrel 120 may be disposed on the second end of rope shaft 110 and extend towards the first end of rope shaft 110, where in one embodiment barrel 120 may be at least twelve inches in length. Barrel 120 may be hollow such that at least a portion of rope shaft 110 or may extend through at least a portion of or through the entire length of barrel 120. In embodiments, rope shaft 110 may be configured to couple with barrel 120 at a lower end of barrel 120. While in another embodiment, rope shaft 110 may extend through the entire length of barrel 120 and couple with a top end of barrel 120, such as by tying rope shaft 110 in a knot on the top end of barrel 120 or any other method of securing the rope to the end of the barrel. Therefore, the knot of rope shaft 110 may be configured to be adjacent to the top end of barrel 120, such that barrel 120 may not slide off rope shaft 110. Barrel 120 may be weighted to increase the force caused by barrel 120 coming in contact with a baseball. The weight of barrel 120 may vary based on the height or size of the baseball player. For example, the weight of barrel 120 may vary from a half ounce to twenty ounces. The weight of barrel 120 may be adjusted based on the weight of a conventional bat that the baseball player may use. Therefore, the weight of barrel 120 may increase for adults, and the weight of barrel 120 may decrease for pre-teen baseball players. In embodiments, barrel 120 may be eight and a half inches in diameter at the sweet spot of barrel 120.

Semi-rigid handle 130 (referred to hereinafter as "rigid handle 130") may be positioned at a first end of rope shaft 110, and may be configured to be utilized as a grip. Rigid handle may be comprised of various materials, such as plastic, hard rubber, or any other material that may maintain its shape. In embodiments, the first end of rope shaft 110 may be configured to extend through rigid handle 130. Rigid handle 130 may be any desired length, wherein the longer the length of rigid handle 130 the less flexibility rope shaft 110 may have. Furthermore, the weight of the rigid handle 130 portion of baseball hitting aid 100 may be greater than the weight of rope shaft 110, but less than the weight of barrel 120. In other embodiments, semi-rigid handle 130 may be a rigid and/or flexible handle.

In embodiments, responsive to the baseball player generating sufficient centrifugal force by spinning their torso at a high enough rotational speed, the centrifugal force applied to rope shaft 110, through rigid handle 130, may require, impel, of force rope shaft 110 to change from a first position to a second position. The centrifugal force required by the baseball player may be based on the length of rope shaft 110 and the weight of barrel 120. Accordingly, the greater the distance between barrel 120 and rigid handle 130, the greater the centrifugal force required to change rope shaft 110 from the first position to the second position. In embodiments, the distance between barrel 120 and rigid handle 130 may be changed by adding an additional rigid handle 130 to rope shaft 110 and/or removing a rigid handle 130 from rope shaft via the first end of rope shaft 110.

In the first position rope shaft 110 may be flexible and be able to be bent at any location, while in the second position rope 110 may be a linear device and allow sufficient force for barrel 120 to hit a baseball. If the baseball player does not generate sufficient centrifugal force applied to rope shaft 110 or the amount of centrifugal force applied to rope shaft 110 decreases, rope shaft 110 may not change from the first position to the second position.

Figure 2:
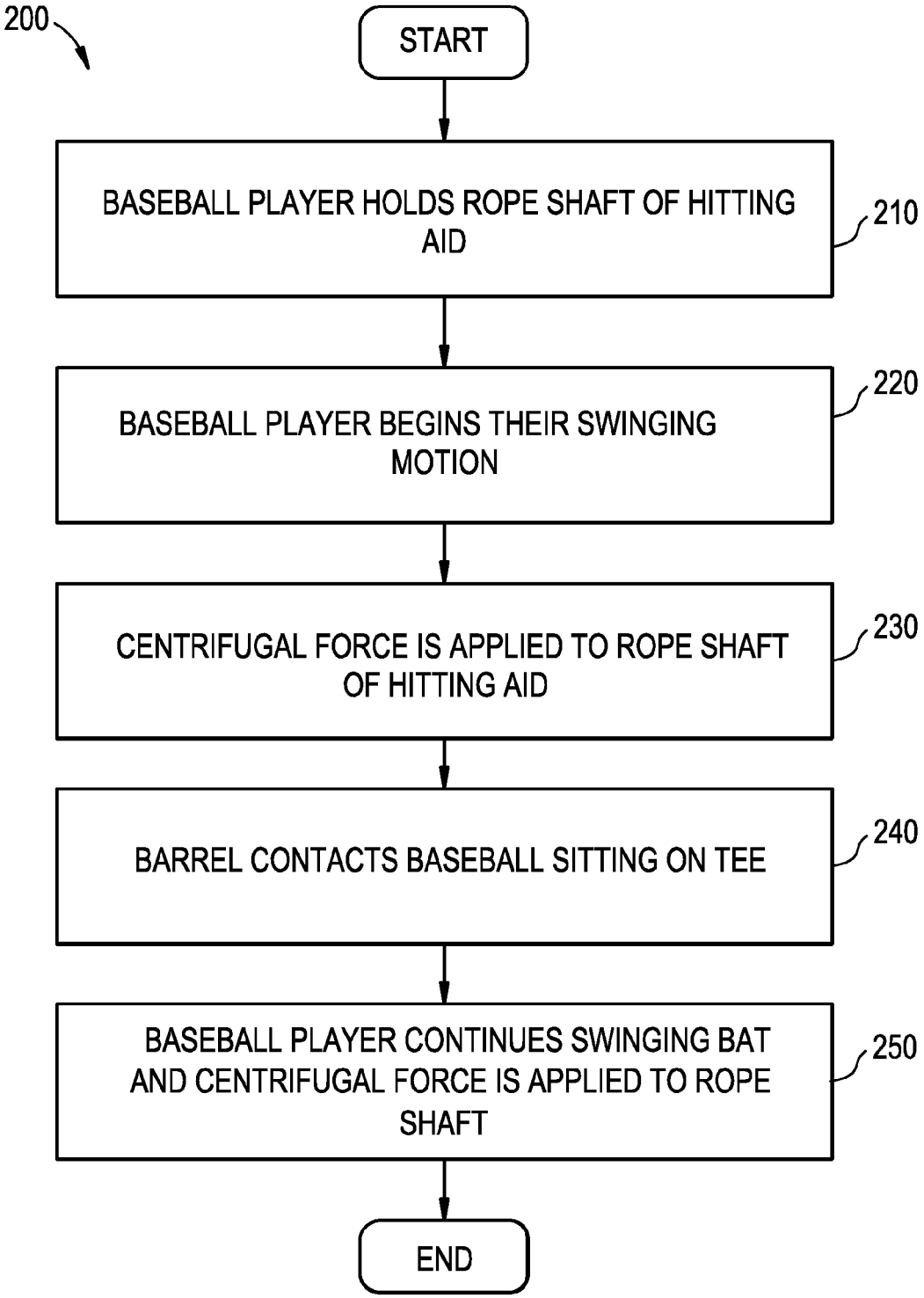
FIG. 2 depicts one embodiment of a method for utilizing a baseball hitting aid.

FIG. 2 illustrates a method 200 for utilizing a hitting aid. The operations of method 200 presented below are intended to be illustrative. In some embodiments, method 200 may be accomplished with one or more additional operations not described, and/or without one or more of the operations discussed. Additionally, the order in which the operations of method 200 are illustrated in FIG. 2 and described below is not intended to be limiting.

At operation 210, a baseball player may hold a first end of a rope shaft. The baseball player may hold the first end of the rope shaft in the same way that the baseball player may hold the handle of a conventional baseball bat. While holding the first end of the rope shaft, the rope shaft may extend over and around a back shoulder of the baseball player resting between the shoulder blades on or near the spine, such that the rope shaft may be positioned adjacent to the baseball player's shoulder. Additionally, the barrel of the hitting aid may be positioned adjacent to or substantially adjacent to the baseball players back. Operation 210 may be performed by a rope shaft and a barrel that is the same as or similar to rope shaft 110 and barrel 120, in accordance with one or more implementations.

At operation 220, the baseball player may extend their front leg away from their body, and turn, rotate, or spin (referred to herein after individual and collectively as "spin") their torso, while keeping their hands in a stationary position.

At operation 230, the centrifugal force generated by the baseball player spinning their torso and the centrifugal force generated by extending their hands may be applied to the rope shaft and barrel. In embodiments, responsive the centrifugal force being applied to the rope shaft and barrel, the rope shaft may be configured to move away from the position curved over the baseball player's shoulder, to a position linearly extending away from the baseball player's body. To increase the centrifugal force applied to the rope shaft and barrel, the baseball player may move their torso forward, while keeping their hand's at a stationary position. Therefore, as the baseball player moved their torso forward, the baseball player's hands will be further away from the initial position of the baseball player's torso. The baseball player hands may then be pulled in response to the baseball player spinning their torso. Operation 230 may be performed by a rope shaft and a barrel that is the same as or similar to rope shaft 110 and barrel 120, in accordance with one or more implementations. The effect of this swing is to understand that the bat is swung with the entire body, not just the arms.

At operation 240, the barrel of the hitting aid may contact a baseball disposed on a baseball tee or by being thrown or tossed by another player or coach. The centrifugal force applied to the barrel through the rope shaft may generate enough force to contact the baseball forcing the baseball to be moved from the tee. Operation 240 may be performed by a barrel that is the same as or similar to barrel 120, in accordance with one or more implementations.

At operation 250, after contacting the barrel of the hitting aid and the baseball, the baseball player may continue to generate centrifugal force such that the rope shaft is maintained in a linear position. By maintain the rope shaft in a linear position; the baseball player may simulate a follow through on their swing. In embodiments, the barrel may be padded because when the baseball player finishes their swing, the barrel may contact the player. Therefore, the barrel may be made of a soft or padded material such that if the barrel contacts the baseball player or another individual, the barrel will not injure or harm the baseball player or other individual. Operation 250 may be performed by a rope shaft that is the same as or similar to rope shaft 110, in accordance with one or more implementations.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present embodiments. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or subcombinations in one or more embodiments or examples. In addition, it is appreciated that the figures provided herewith are for explanation purposes to persons ordinarily skilled in the art and that the drawings are not necessarily drawn to scale.

The flowchart and block diagrams in the flow diagrams illustrate the architecture, functionality, and operation of possible implementations of systems, methods, and computer program products according to various embodiments of the present embodiments. In this regard, each block in the flowchart or block diagrams may represent a module, segment, or portion of code, which comprises one or more executable instructions for implementing the specified logical function (s). It will also be noted that each block of the block diagrams and/or flowchart illustrations, and combinations of blocks in the block diagrams and/or flowchart illustrations, may be implemented by special purpose hardware-based systems that perform the specified functions or acts, or combinations of special purpose hardware.

As used herein, the terms "comprises," "comprising," "includes," "including," "has," "having," or any other variation thereof, are intended to cover a non-exclusive inclusion. For example, a process, article, or apparatus that comprises a list of elements is not necessarily limited to only those elements but may include other elements not expressly listed or inherent to such process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

What is claimed is:

1. A baseball hitting aid comprising:

a rope shaft comprised of a woven fabric configured to be in a flexible position in a first mode, and the rope shaft being configured to be in a linear positioning a second mode, the rope shaft including a first end and a second end, the rope shaft having a first diameter, the first end of the rope shaft and the second end of the rope shaft forming outer boundaries of the baseball hitting aid;

a rigid handle coupled around the first end of the rope shaft, the rigid handle having a first hollow chamber extending from a first end of the rigid handle to a second end of the rigid handle, the rope shaft being configured to be inserted through the first hollow chamber from the first end of the rigid handle to the second end of the rigid handle, and a first end of the rope shaft being configured to be positioned adjacent to an outer surface of the first end of the rigid handle, the rigid handle having a second diameter, the first end of the rope shaft extending past the first end of the rigid handle; and a cylindrical barrel configured to be coupled with the second end of the rope shaft, the cylindrical barrel including a second hollow chamber, the second hollow chamber extending from a first end of the cylindrical barrel to a second end of the cylindrical barrel, the cylindrical barrel having a third diameter that is greater than the first diameter of the rope shaft and the second diameter of the rigid handle, the third diameter being a uniform distance, a length of the cylindrical barrel being longer than a length of the rigid handle, the length of the cylindrical barrel being at least twelve inches in length, and being configured to contact a baseball when the rope shaft is in the linear position, wherein the cylindrical barrel has a greater weight than the rope shaft, the rope shaft being configured to be inserted through the second hollow chamber from the first end of the cylindrical barrel to the second end of the cylindrical barrel, wherein the second end of the rope shaft is configured to be positioned adjacent to an outer surface of the second end of the cylindrical barrel, wherein a weight of the rigid handle is greater than a weight of the rope shaft but less than the weight of the cylindrical barrel, the second end of the rope shaft extending past the second end of the cylindrical barrel.

2. The baseball hitting aid of claim 1, wherein at least a portion of the rope shaft is configured to extend into the second hollow chamber of the cylindrical barrel.

3. The baseball hitting aid of claim 1, wherein the woven fabric is configured to be bent at any point when no force is applied to the rope shaft.

4. The baseball hitting aid of claim 1, wherein the rope shaft is configured to change from the first mode to the second mode when centrifugal force is applied to the rope shaft.

5. The baseball hitting aid of claim 1, wherein an amount of centrifugal force required to change the rope shaft from the first mode to the second mode is based on a weight of the cylindrical barrel.

6. The baseball hitting aid of claim 5, wherein an amount of centrifugal force required to change the rope shaft from the first mode to the second mode is based a distance from the rigid handle to the cylindrical barrel.

* * * * *